US006059552A

United States Patent [19]

Martensen et al.

[11] Patent Number: 6,059,552

[45] Date of Patent: May 9, 2000

[54] HYDRAULIC VANE MACHINE

[75] Inventors: Lars Martensen, Sønderborg; Gunnar Lyshøj Hansen, Nordborg, both of Denmark

[73] Assignee: Danfoss A/S, Nordborg, Denmark

[21] Appl. No.: 09/015,114

[22] Filed: Jan. 29, 1998

[30] Foreign Application Priority Data

Jan. 29, 1997 [DE] Germany ..... 197 03 112

[51] Int. Cl.[7] ..... F01C 17/00

[52] U.S. Cl. ..... 418/182; 418/259; 418/270

[58] Field of Search ..... 418/182, 259, 418/270

[56] References Cited

U.S. PATENT DOCUMENTS

| | | | |
|---|---|---|---|
| 2,192,588 | 3/1940 | Heckert | 418/182 |
| 3,582,246 | 6/1971 | Traut | 418/264 |
| 3,964,844 | 6/1976 | Whitmore | 418/133 |
| 4,822,265 | 4/1989 | Johnson | 418/182 |
| 5,006,048 | 4/1991 | Jow | 418/182 |

*Primary Examiner*—Thomas Denion
*Assistant Examiner*—Thai-Ba Trieu
*Attorney, Agent, or Firm*—Lee, Mann, Smith, McWilliams, Sweeney & Ohlson

[57] ABSTRACT

Hydraulic vane machine with a stator having a stator bore with a guiding contour, a rotor arranged in the stator bore and having substantially radially movable vanes bearing on the guiding contour, and a shaft connected fixedly rotatable with the rotor via a coupling. In such a machine the operation behaviour must be improved. For this purpose the coupling has a transmission element located horizontally with the shaft being vertical. The transmission element is radially displaceable relative to the shaft in one direction and is laterally displaceable relative to the rotor in a second direction.

14 Claims, 1 Drawing Sheet

HYDRAULIC VANE MACHINE

BACKGROUND OF THE INVENTION

The invention concerns a hydraulic vane machine with a stator having a stator bore with a guiding contour, a rotor arranged in the stator bore and having substantially radially movable vanes bearing on the guiding contour, and a shaft connected fixedly rotatable with the rotor via a coupling.

Such machines are known both as motors (U.S. Pat. No. 4,376,620; U.S. Pat. No. 3,254,570) and as pumps (U.S. Pat. No. 3,255,704). For convenience the following description is based on a motor.

In one section, the diameter of the guiding contour of the stator bore is approximately equal to the diameter of the rotor. In another section the diameter of the guiding contour is larger. Between these two sections there are transition sections. When the rotor rotates, the vanes will extend radially outwards in the larger sections, and can then be exposed to the pressure of a hydraulic fluid. This pressure causes the production of a torque, which turns the rotor. At the end of the section with the increased diameter the vanes are retracted into the rotor, and the pressurised fluid is drained off, e.g. to a tank connection.

In this connection the vanes, together with the rotor, the stator and side walls, enclose cells, also named vane cells. It is obvious that during operation some limiting walls of the vane cells are movable in relation to the cells. When the side plates are stationary in the stator, the side walls are movable relative to the cells. The sealing towards the rotor is required. When the side walls rotate with the rotor, they stand still in relation to the cells. However, then the side walls must turn in relation to the stator, meaning that the sealing will be required here.

Such a sealing is practically only available, when the corresponding parts bear on each other with a certain pressure. However, this causes increased frictional values and a corresponding wear. This again leads to undesired leakages.

Attempts can be made to realise a dimensioning, which will keep the forces acting on the individual parts in balance. However, this is usually only possible for specific operation conditions. E.g. when the shaft is loaded unilaterally, unequal forces occur on the contact surfaces between stator and rotor, which are practically impossible to balance. Such a constellation e.g. occurs when the shaft is loaded unilaterally in the radial direction. This is the case when driving e.g. a vee belt or a toothed belt. Here the shaft is pulled in a certain direction by the tension of the belt, which normally leads to a small tilting of the rotor, which will have the detrimental effects described above.

It is the task of the invention to improve the operational behaviour of a hydraulic vane machine.

SUMMARY OF THE INVENTION

With a hydraulic vane machine as described in the introduction, this is solved in that the coupling has a transmission element, arranged in a level, to which the shaft is vertical, in a first direction radially displaceable relative to the shaft and in a second direction displaceable relative to the rotor.

This embodiment does away with the fixed co-ordination of rotor and shaft known in traditional machines, e.g. Ceased by rotor and shaft being made in one unit or by a multi-spline connection. On the contrary, rotor and shaft are isolated from each other, so that small movements of the shaft, which could originate from an unequal load, will have no direct influence on the rotor. In particular, it is possible that the shaft will perform lateral, i.e. radial displacement movements, or even tilt, without causing a corresponding load of the rotor. Nevertheless, the rotary movement of the rotor is transmitted to the shaft (or vice versa). This is the purpose of the transmission element, in which the shaft can be displaced laterally to a certain extent, i.e. vertically to its axis. In another direction the rotor can be displaced in relation to the transmission element, so that a relative lateral movement between shaft and rotor is possible in all directions. The movements of the shaft in relation to the rotor are normally not very large. In many cases they are limited to the bearing clearance, i.e. in the range of 3/10 mm. As the control of the frictional forces between moving parts is now improved, it is also possible to use hydraulic fluids with poorer lubrication properties than the traditionally used synthetic oils. Thus, it is e.g. possible to use water as hydraulic fluid. In a motor a unilateral loading of the rotor will particularly cause problems at the start. As, however, this unilateral loading of the rotor is avoided, the starting behaviour of the motor can be improved. The use of a transmission element between shaft and rotor will also do away with problems, which could be caused by a corrosion of the connection between shaft and rotor, like e.g. in connection with a multi-spline connection in water.

In a preferred embodiment it is provided that the first and the second directions enclose a right angle. In this case, relative movements between the shaft and the rotor are possible in practically all directions under the same conditions. There is no preferred direction.

It is particularly preferred that the transmission element has a central recess, in which the shaft is arranged, by which the recess has two parallel guiding surfaces bearing on corresponding countersurfaces of the shaft. The guiding surfaces and the countersurfaces define the direction, in which the shaft can be displaced in relation to the transmission element. At the same time the bearing of the guiding surface and the countersurface on each other provides the required torque transmission. As stated above, the relative movements are normally relatively small, and therefore a relatively large shaft diameter can be used (or the corresponding section of the shaft can be extended), so that also high torques can be absorbed.

Preferably, the rotor has two projections in the second direction arranged diametrically opposite to each other radially outside the shaft, which projections are meshing with the transmission element. Thus the transmission element can be displaced relative to the rotor in the direction along which the two projections are arranged. As both projections are arranged outside the shaft, they can transmit the same torque, even though their dimensions are smaller, as the lever arm is longer. Correspondingly the transmission element can be made stable.

Advantageously, an intermediary piece of a synthetic material is arranged between each projection and the transmission element. This intermediary piece is then softer than the transmission element or the projection, respectively. This means that on load changes it can yield and absorb shocks.

In this connection it is particularly preferred that the synthetic material and the material of the transmission element co-operate without friction. This reduces frictional losses, which is particularly advantageous when water is used as hydraulic fluid. Due to the low friction, a relative movement of rotor and shaft can take place with practically no delay, thus reducing the risk of a unilateral load or canting of the rotor in the stator.

Advantageously, the transmission element has a recess for admission of each projection, whose length is larger than the diameter of the projection. Thus, the projection is always kept inside the transmission element. A relative movement of the transmission element in relation to the rotor in the second direction is still possible.

Preferably, the recess is arranged in the edge area of the transmission element. Thus the lever arm between the rotor and the transmission element is made as large as possible. The transmitted torque can be correspondingly large.

Advantageously, the projections are bolts, which are inserted in the rotor. This is a relatively simple way of producing the projections. The dimensioning of the bolts can be correspondingly strong.

Preferably, the rotor is made of several parts bearing axially on each other and connected with each other by means of the bolts. Thus already existing parts are used to provide the torque transmission between the rotor and the transmission element.

Preferably, the shaft penetrates the rotor at least partly, by which the rotor and the shaft support each other via a rocker bearing. This provides a certain co-ordination between the rotor and the shaft, by which the rocker bearing permits the shaft to assume an orientation in relation to the rotor, which deviates from the axial direction of the rotor. Thus it is e.g. possible to arrange the shaft on both sides of the rotor. As a tolerance is permitted, the bearings can be formed in a correspondingly cheap way.

It is preferred that the rocker bearing is made as a round cord sealing ring. Such a ring is also called an O-ring. It permits not only a tilting of the shaft in relation to the rotor, but also a small lateral displacement movement. Correspondingly the forces between the moving parts of rotor and stator can be balanced, however an irregular loading of the shaft is still permitted.

Alternatively, the bore of the rotor receiving the shaft can also have a wall, whose section is concave. To simplify the production, a bushing with a correspondingly shaped inner wall can be inserted in the rotor.

BRIEF DESCRIPTION OF THE DRAWINGS

In the following the invention is described on the basis of a preferred embodiment in connection with the drawings, showing.

DETAILED DESCRIPTION OF THE INVENTION

Figure 3:
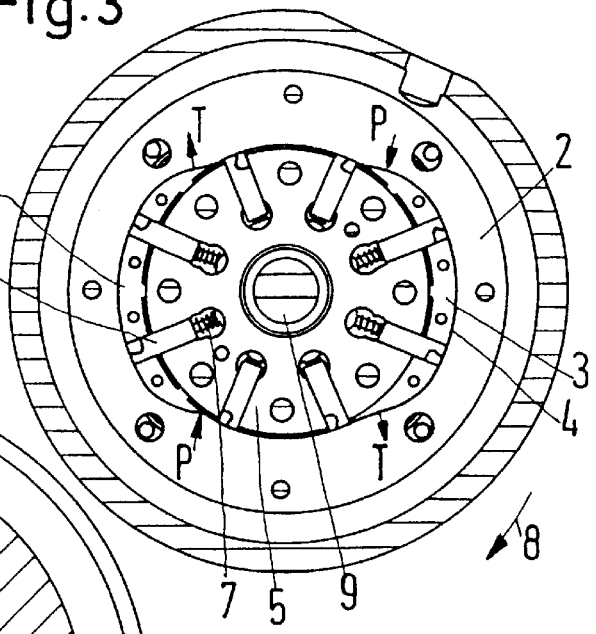
FIG. 3 a section III—III according to FIG. 1

A vane cell motor 1, "vane motor" for short, has a stator 2, which, as appears from FIG. 3, has a stator bore 3 with a guiding contour 4. A rotor 5 is arranged rotatably in the stator bore 3. The rotor 5 has a number of vanes 6, which are pressed radially outwards by means of springs 7, thus bearing on the guiding contour 4, i.e. on the inner wall of the stator bore 3.

Basically, the principle of such a motor is known. Via schematically shown connections P at the beginning of the diameter extension of the guiding contour 4 hydraulic fluid under pressure is supplied, which hydraulic fluid with lower pressure can be drained off again via the schematically shown connections T. For this purpose the connections P are connected with e.g. a pump and the connections T are connected with e.g. a tank. Due to the pressure difference between the connections P and T, the vanes 6, which extend at the beginning and retract at the end of the diameter extension of the guiding contour 4, will be exposed to a pressure difference, which leads to a torque in the direction of the arrow 8.

Further, a shaft 9 is carried in the housing 2. The shaft 9 penetrates the rotor 5 and is supported in the housing 2 with two bearings 10, 11. However, it is not directly connected with the rotor 5, but via a coupling 12, whose top view is shown in detail in FIG. 2. Further, a tilting link in the form of an O-ring 13 is provided between the shaft 9 and the rotor 5, which link produces a certain orientation between the rotor 5 and the shaft 9. The O-ring is resilient to a certain extent, so that a small displacement or tilting movement between shaft 9 and rotor 5 is permitted. Correspondingly, there is a small gap between the shaft 9 and the rotor 5, which is, however, so small that it cannot be seen on the figure.

Figure 1:
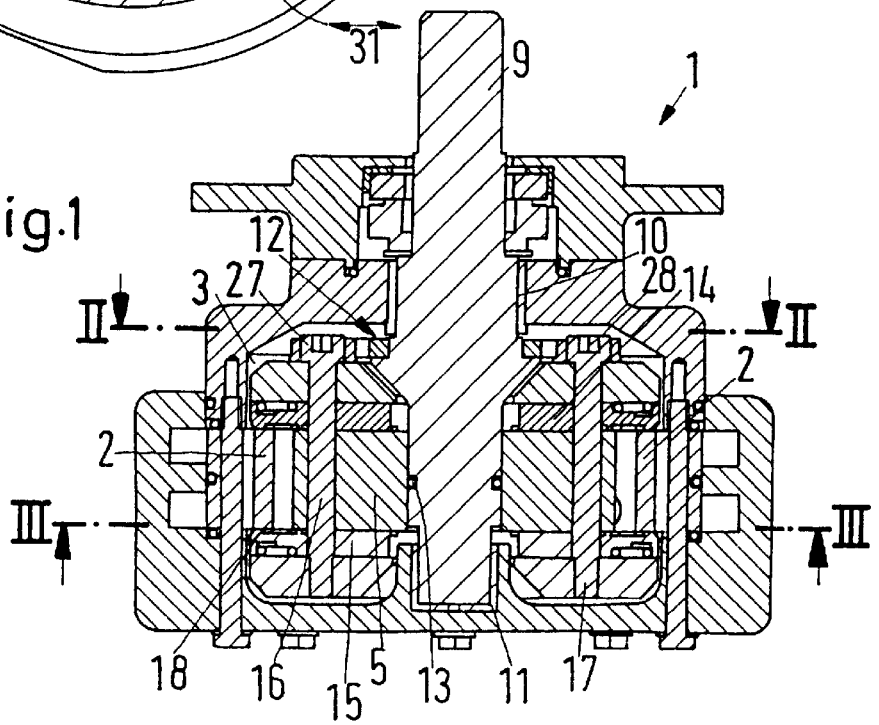
FIG. 1 a longitudinal section through a vane cell motor

As appears particularly from FIG. 1, the rotor 5 is provided with a side plate arrangement 14, 15 on each axial side. The side plate arrangements 14, 15 rotate together with the rotor 5. They are connected with the rotor by means of bolts 16, 17. In a radially external area 18, the side plate arrangements 14, 15 bear on the stator 2 and must be moved in relation to the stator. At the same time, cells 18*a*, formed in this area between the vanes 6 during operation, must be sealed.

To obtain a good sealing during operation in the area 18 between the rotor or the side plate arrangements 14, 15, respectively, and the stator 2, it is required that here the side plate arrangements 14, 15 are pressed against the stator 2 with a certain force. However, due to the friction occurring here, this causes a certain wear. A balancing of the corresponding forces will keep this wear small. However, it is a condition that the rotor 5 always has the same orientation in the stator 2. When the rotor 5 tilts in the stator 2, there is a considerable risk of additional wear. This especially applies when water is used as hydraulic fluid, as water has practically no lubricating properties.

Such a tilting load e.g. occurs when the shaft 9 is exposed to an irregular load. Such a situation particularly occurs when the shaft drives a vee belt or a toothed belt. Correspondingly, lateral displacement movements, i.e. radial movements of the rotor 5 in relation to the housing, will cause problems.

To avoid such movements of the rotor 5, a decoupling between the shaft 9 and the rotor 5 is provided. Thus, the shaft can move freely within certain limits in relation to the rotor 5. Normally, these movements are not very large. They are within the range of a bearing play, i.e. about 3/10 mm.

Figure 2:
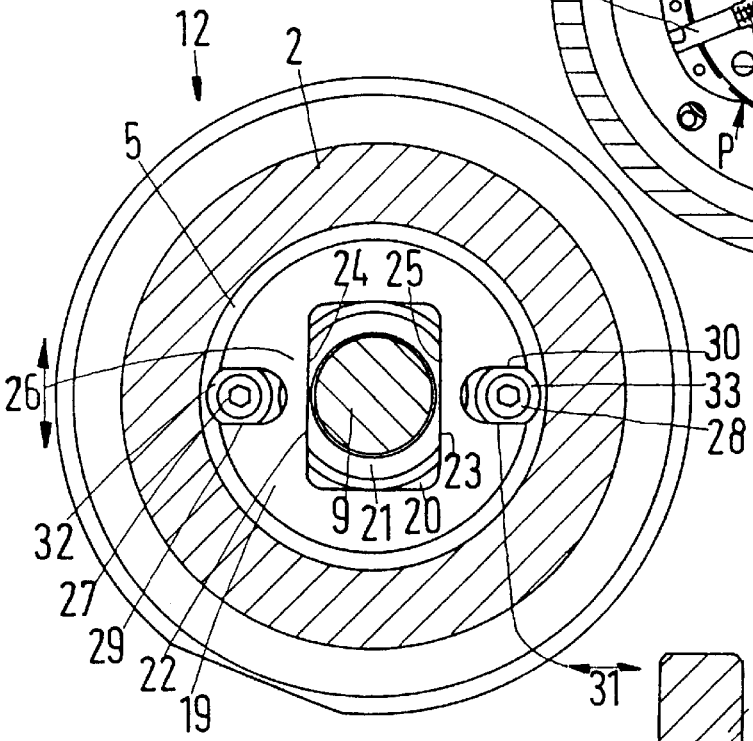
FIG. 2 a section II—II according to FIG. 1

However, to accomplish a torque transmission between the rotor 5 and the shaft 9, the coupling 12 shown in FIG. 2 is provided.

The coupling 12 has a transmission link 19, having a central recess 20, through which the shaft 9 is led. In the axial height of the transmission link 19 the shaft 9 has a thickening 21. On two opposite sides 22, 23 the thickening 21 is flattened. A corresponding flattening 24, 25 is provided in the wall of the recess 20. The sides 22, 23 bear tightly on the flattenings 24, 25. Due to this, a torque transmission from the shaft 9 to the transmission link 19 and vice versa is possible. Further, a moving of the transmission link 19 relative to the shaft 9 in the direction of the double arrow 26 is permitted. This moving occurs parallel to the sides 22, 23 or the flattenings 24, 25, respectively. For this purpose the recess 20 has a width between the two sides 24, 25, which is somewhat larger than the diameter of the shaft 9 outside the thickening 21.

The bolts 16, 17 project axially from the side plate arrangement 14. Their heads extend into slot-shaped recesses 29, 30, which originate from the edge of the transmission link 19. The length of the recesses 29, 30 is somewhat larger than the diameter of the heads 27, 28 of the bolts 16, 17, so that a moving of the transmission link 19 relative to the rotor 5 in the direction of the double arrow 31 is also possible. This direction is called the second direction. The first direction 26 is vertical to the second direction 31.

When the shaft 9 moves in relation to the rotor 5, e.g. through a lateral displacement or a tilting, such a movement is possible, as the transmission link 19 permits it, without disconnecting the rotation connection between the rotor and the shaft. Also a unilateral loading of the shaft 9 involves practically no risk that the rotor will also assume a tilted position in relation to the stator 2.

A bushing 32, 33 of a synthetic material, particularly a friction reducing synthetic material, e.g. PEEK, can be provided between the heads 27, 28 and the transmission link. These bushings 32, 33 have two tasks. One is that to a limited extent they can absorb impacts (shocks), as they are somewhat more resilient than the transmission link 19, which is made of a harder material, e.g. steel. The other task is to reduce the friction between the bolt heads 27, 28 and the transmission link 19, so that a relative movement is not influenced by frictional losses.

The torque transmission occurs from the rotor 5 to the bolts 16, 17 and their heads 27, 28, and from there to the transmission link 19, which then drives the shaft 9. In this connection the lever arm between rotor 5 and transmission link 19 is relatively large. Normally such an embodiment with stationary side plates will not permit such a large diameter, as the opening, through which the torque can be transmitted, limits the diameter.

Of course, alternative embodiments are possible. E.g. the recesses 29, 30 can be V-shaped. Instead of the two bolts shown, there could also be three, four or more bolts, as long as they permit the transmission link 19 to move in a different direction in relation to the rotor 5 as in relation to the shaft 9.

The bolts could be replaced by pins connected with the rotor. Of course, it is also possible to let the bolts or journals project from the transmission link, in a way that they mesh with corresponding recesses in the rotor.

What is claimed is:

1. A hydraulic vane machine with a stator having a stator bore with a guiding contour, a rotor arranged in the stator bore and having substantially radially movable vanes bearing on the guiding contour, and a shaft connected fixedly rotatable with the rotor via a coupling, the couplings including a transmission element located in a plane, the shaft being normal to the plane, and the transmission element being radially displaceable relative to the shaft in a first direction and being laterally displaceable relative to the rotor in a second direction, the first and second directions lying in the plane.

2. The machine according to claim 1, in which the first and the second directions are at right angles to one another.

3. The machine according to claim 1, in which the transmission element includes a central recess through which the shaft passes, the recess having two parallel guiding surfaces bearing on corresponding countersurfaces of the shaft.

4. The machine according to claim 1, in which the rotor includes two projections located diametrically opposite to each other radially outside the shaft, the projections meshing with the transmission element.

5. The machine according to claim 4, in which an intermediary piece of a synthetic material is located between each projection and the transmission element.

6. The machine according to claim 5, in which the synthetic material and the transmission element co-operate without friction.

7. The machine according to claim 4, in which the transmission element includes a recess for each projection, each recess having a length larger than the diameter of each projection.

8. The machine according to claim 7, in which each recess is located in an edge area of the transmission element.

9. The machine according to claim 4, in which the projections comprise bolts inserted in the rotor.

10. The machine according to claim 9, in which the rotor comprises several parts bearing axially on each other and connected with each other by means of the bolts.

11. The machine according to claim 1, in which the shaft penetrates the rotor at least partly, and the rotor and the shaft support each other through a rocket bearing.

12. The machine according to claim 11, in which the rocker bearing comprises a round cord sealing ring.

13. The machine according to claim 11, in which the rocker bearing comprises a wall with a concave section in the bore receiving the shaft.

14. The machine according to claim 13, in which the bore is made in a bushing inserted in the rotor.

* * * * *